United States Patent [19]

Weber et al.

[11] Patent Number: 4,553,482

[45] Date of Patent: Nov. 19, 1985

[54] PRACTICE PROJECTILE

[75] Inventors: Adolf Weber, Neunkerchen; Carmen Porzelt, Nuremberg, both of Fed. Rep. of Germany

[73] Assignee: Diehl GmbH & Co., Nuremberg, Fed. Rep. of Germany

[21] Appl. No.: 611,928

[22] Filed: May 22, 1984

Related U.S. Application Data

[63] Continuation of Ser. No. 331,777, Dec. 17, 1981, abandoned.

[30] Foreign Application Priority Data

Dec. 20, 1980 [DE] Fed. Rep. of Germany ..... 3048206

[51] Int. Cl.[4] ..... F42B 13/20; F42B 9/20

[52] U.S. Cl. ..... 102/529; 102/498; 102/521

[58] Field of Search ..... 102/334, 364, 377, 378, 102/444, 458, 498, 501, 502, 506, 517, 513, 529, 521

[56] References Cited

U.S. PATENT DOCUMENTS

| | | | |
|---|---|---|---|
| 2,793,590 | 5/1957 | Brandt | 102/529 |
| 2,993,648 | 7/1961 | Blackwell | 102/367 X |
| 3,374,740 | 3/1968 | Voda | 102/364 X |
| 3,422,764 | 1/1969 | Kaiser | 102/233 |
| 4,016,796 | 4/1977 | Brannan | 89/1.806 |
| 4,140,061 | 2/1979 | Campoli | 102/529 |
| 4,215,632 | 8/1980 | Sie | 102/529 |
| 4,242,960 | 1/1981 | Boeder et al. | 102/529 X |
| 4,393,783 | 7/1983 | Goes et al. | 102/529 |

FOREIGN PATENT DOCUMENTS

| | | | |
|---|---|---|---|
| 2542830 | 4/1976 | Fed. Rep. of Germany . | |
| 7528912 | 7/1976 | Fed. Rep. of Germany . | |
| 2820455 | 1/1979 | Fed. Rep. of Germany . | |
| 2231549 | 2/1979 | Fed. Rep. of Germany . | |
| 2756420 | 7/1979 | Fed. Rep. of Germany . | |
| 2028982 | 3/1980 | United Kingdom | 102/529 |
| 2085132 | 4/1982 | United Kingdom | 102/501 |

OTHER PUBLICATIONS

Explosivstoffe by Diehl, 1979.

*Primary Examiner*—Harold J. Tudor
*Attorney, Agent, or Firm*—Scully, Scott, Murphy & Presser

[57] ABSTRACT

A practice projectile for large-caliber cannons corresponds, over a first flight trajectory portion, to a combat projectile in trajectory and target strike position. At the beginning of a second flight portion, the projectile self-destructs to prevent flight of projectile parts out of the second flight portion. This is attained by a plurality of mutually independent pyrotechnic delay charges which are triggered upon firing and, after burning down, ignite gas generators. The pressurized gas generated by the gas generators ruptures the suitable designed projectile connection. The individual projectile components are separated from each other either by the pressurized gas and/or through the static air pressure and through the residual rotation of the projectile.

7 Claims, 20 Drawing Figures

PRACTICE PROJECTILE

This is a continuation of co-pending application Ser. No. 331,777 filed Dec. 17, 1981, now abandoned.

BACKGROUND OF THE INVENTION

1. Field of the Invention

The present invention relates to a self-destruct device for a practice projectile which includes plurality of mutually independent disintegrators.

During practice firing over firing ranges, provision must be made that the practice projectile will substantially conform with a live projectile for approximately three kilometers of the flight trajectory and the impact location, and will thereafter be destroyed within a safety zone and whereupon the projectile components will descend to to the ground.

2. Discussion of the Prior Art

From German Pat. No. 25 42 830 there has become known a detonator for practice projectiles with a plurality of mutually independently acting disintegrators or self-destructors. Each of these disintegrators acts on an intensifying charge associated therewith. This will ensure that upon the failure of a disintegrator, the other disintegrators will trigger the intensifying charges and thereby effect the self-destruction of the practice projectile through an associated explosive charge. Due to the utilization of explosive, prescribed safety conditions must be fulfilled with respect to the detonator, which can only be fulfilled through expensive measures.

Through the disclosure of German Laid-open patent application No. 22 59 861 there has become known a rifle grenade which, for the assured triggering of the detonator requires initiation thereof already upon firing of the grenade. Hereby, a striker member is driven against a detonating element under the compressive effect of the propellant gases.

SUMMARY OF THE INVENTION

Accordingly, it is an object of the present invention to provide a practice projectile with a detonator, which avoids the need for an explosive, which is simple in construction, inexpensive and reliably disintegrates a practice projectile with an assurance of almost 100%, which however, in the first portion of the flight trajectory conforms to a combat projectile, and only thereafter will self-destruct without external means.

The foregoing object is achieved is that the projectile is divisible into at least two parts through preset breaking locations, in which at least two pyrotechnic time-delayed disintegrators are provided with pyrotechnic gas generators, and wherein the disintegrators are activated through means becoming effective upon the firing of the projectile.

The advantage which is achieved through the inventive measure is that no mechanically movable or electrically-controllable components are required so that, through exclusively mechanical connections of the projectile parts and their pyrotechnic disintegrators, there is achieved a functional dependability for the practice projectile which was heretofore not attainable.

The assembling security has also been increased, since the components which are of significance relative to the disintegration are small in number.

The projectile portions are so designed so that, after the loosening of the projectile interconnection there will be present the necessary air resistance and instability for the rapid descent thereof.

Further advantages and features of the practice projectile which is constituted of only few and simple parts is described in detail herein-below.

BRIEF DESCRIPTION OF THE DRAWINGS

Reference may now be had to the following exemplary embodiments of the invention, taken in conjuction with the accompanying drawings; in which.

DETAILED DESCRIPTION

Figure 1:
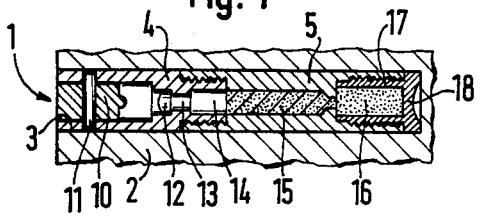
FIG. 1 illustrates an acceleration-dependent pyrotechnic disintegrator.

In collective of the exemplary embodiments there is employed pyrotechnic self-destructor or disintegrator ascertainable from FIG. 1 of the drawings. Pursuant to FIGS. 3 to 6, in one part 2, disintegrators 1 are arranged within a plurality of bores 3. Each disintegrator 1 consists of two threadingly interconnected conduits 4 and 5, a hammer 10, a shear pin 11, an impact-sensitive detonator cap 12, an ignition passageway 13, a pressure expansion chamber 14, a pyrotechnic delay charge 15 pursuant to MIL-C-1373, and a gas-pressure generating charge 16 of nitrocellulose with a high nitroglycerine content contained in a cup 17 with a rupture plate 18.

Figure 2:
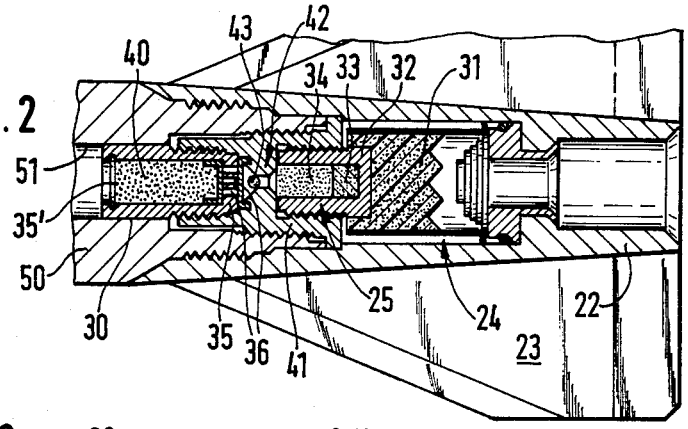
FIG. 2 illustrates a tracer arrangement with a gas generator.

Pursuant to FIG. 2, provided in a projectile shell 22 with aerodynamic guidance mechanism 23 is a tracer arrangement 24 with pyrotechnic igniter 25 for a disintegrator or gas generator 30. The igniter 25 consists of a capsule 32 extending into the luminescent compound 31, with a compound 33 ignitable through heat and a gas pressure-generating propellant charge 34. This capsule 32, and a capsule 35 with apertures 36 for the gas pressure-generating charge 40 of nitrocellulose with high nitroglycerine content are seated in a receiver 41. The receiver 41 is provided with a check valve 42 consisting of a ball 43 and a valve seat (not shown in detail) and passageway. A shank 50 is threaded together with the sleeve 22 and supports the receiver 41. During burning down of the luminescent compound 31, the latter triggers the compound 33, and the latter the propellant charge 34, whose gases ignite the charge 40 through the check valve 42. The gas quantity which is generated by the charge 40, after destruction of the rupture plate 35' flows into the pressure chamber 51 in the shank 50.

The compound 31 generates heat as it burns down, which is transmitted through the capsule 32 to the compound or charge 33. The compound 33 is ignitable through heat at predetermined temperature levels (°C.). This signifies that after a predetermined flight time of the projectile, and still prior to the completion of the burning down of the luminescent compound 31, the temperature has risen to such an extent as to ignite the heat-sensitive compound. The capsule 32 bodily separates the luminescent compound 31 from the charge 33 in order to avoid an immediate disintegration of the projectile.

Figure 3:
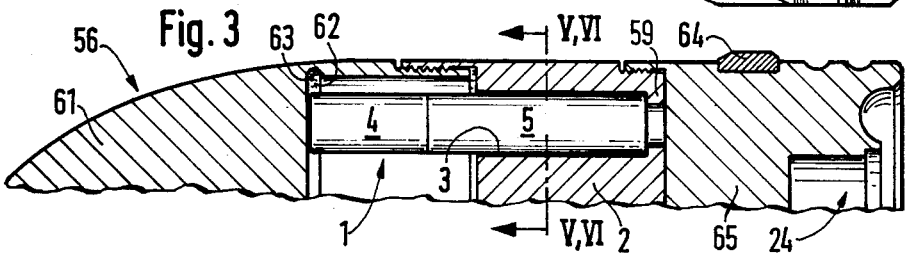
FIGS. 3 to 6 illustrate three spin-stabilized practice projectiles including cross-sectional views thereof.
Figure 5:
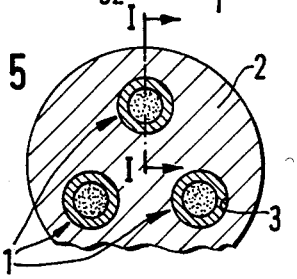

Pursuant to FIGS. 3 and 5, arranged within a spin-stabilized projectile 56 are three disintegrators 1 in one part 2, supported with play in the bores 3 through the collar 59. The conduits 4 are supported on a cone 61. The cone 61 is radially limited by a groove 62 which defines an annular breaking location 63. The nose cone 61, the part 2, and a base 65 which is provided with a guide ring 64 and the tracer arrangement 24, are screwed together.

Figure 4:
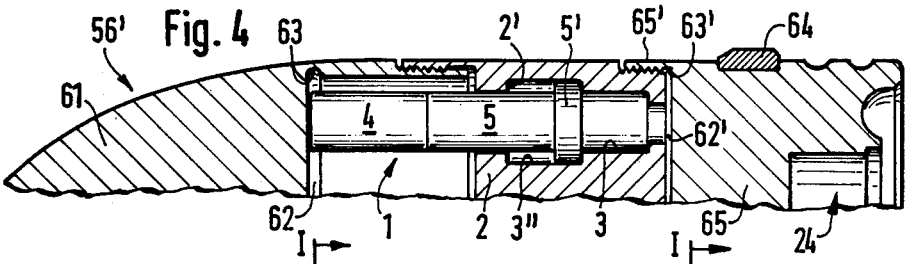

Pursuant to FIG. 4, the embodiment of FIG. 3 is modified through a second breaking location 63' on a projectile 56'. This breaking location 63', which ruptures subsequent to the rupture of the breaking location 63, is formed by a groove 62' and the shell 65' of the part 65. Provided in the part 2 is a piston guidance 3" for a piston 5' on the conduit 5.

The gas pressure of the module 1 displaces the latter along to the length of the piston guidance 3" and destroys the breaking location 63. Piston 5 strikes up against the collar 2'. Therafter, the gas pressure destroys the breaking location 63'.

Figure 6:
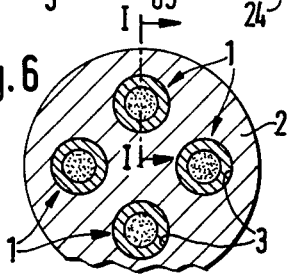

According to FIGS. 5 and 6, in these embodiments there are provided, respectively, three and four disintegrators 1 in the part 2.

The function of the practice projectiles pursuant to FIGS. 3 and 4 consists of that, due to the firing acceleration of the projectiles 56, 56', there are generally simultaneously sheared off the shear pins 11 of the three or, respectively, four disintegrators 1. The hammers 10 strike against the fuse caps 12, whose tongues of flames ignite the delay compounds 15 which are known from the hand grenade fuses. The delay compounds 15 which are burned through after the predetermined time interval ignite the gas pressure-generating charges 16. Because of the pressure development there will rupture the rupture plates 18, and the gas pressure acting in the bores 3 and in the disintegrators 1, presses through the conduits 4, 5 against the nose cone 61 and leads to the fracture of the breaking location 63, and subsequently in time to that of the correspondingly cross-sectioned breaking location 63'.

The wing-stabilized practice projectiles pursuant to FIGS. 7 to 15 are provided with known propelling surfaces 17 which, in a usual manner, transmit the thrust or pushing forces of the propellant charge through a sawtooth arrangement 70' to the body of the projectile which, after leaving from the weapon barrel, will detach from the projectile. A propelling surface of that type is shown, for example, in FIG. 7.

The practice projectiles 71 to 78 incorporate the following substantially coinciding and correspondingly acting components:

Nose cone 80, disintegrator support 81 with disintegrators 1, body 82 (parts 82', 82") in a single-part or multi-part construction with separation in the axial direction or at right angle thereto, shank 50, sleeve 22 with guidance mechanism 23, load-transmissive and firm-fittingly connected hinges 6 to 9

Figure 7:
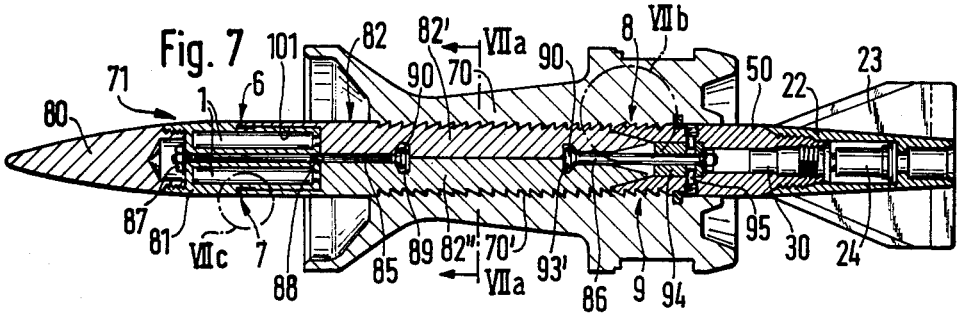
FIGS. 7 to 12 illustrate wing-stabilized practice projectiles.
Figure 7A:
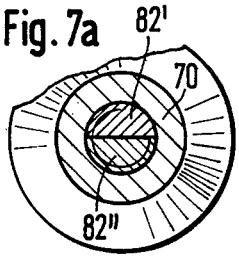
Figure 7B:
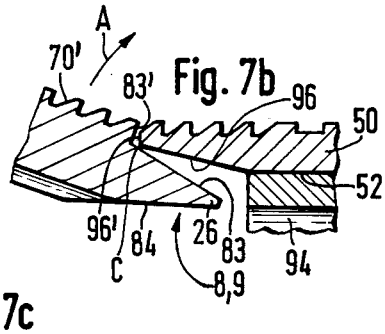

According to FIGS. (7 and 7*a*), there are provided two threaded bolts 85, 86 with nuts 87 and a breaking location 88 formed by a reduced diameter cross-section. The bolt 85, by means of its head 90 engaging into the recess 89, connects the disintegrator support 81 and 82", which pursuant to FIG. 7*b*, are radially outwardly pivotable about the hinges 8, 9. The parts 82' and 82" act through an external and inner cone 83, 84 with the collar 83' as hinge trunnions 26 in the hinge support 80, which is formed by the conical opening 96 and the end surface 96' of the shank 50. The bolt 86 lies with its head 90 in the recess 93' and is screwed together with a piston 94. The piston 94 is fixed in the bore 52 of the shank 50 by means of shear pins 95.

Figure 7C:
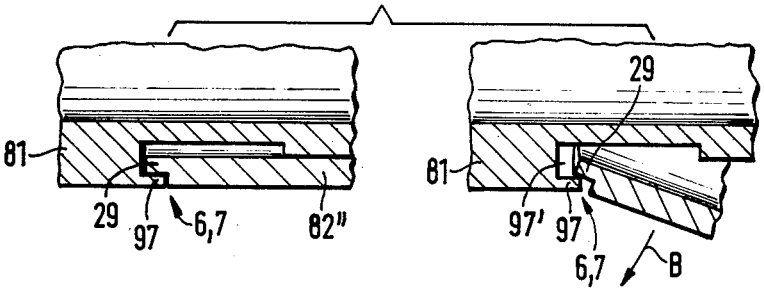

The hinges 6, 7, according to FIG. 7*c*, consist of the collar 97 with the recess 97' and of the semi-circular hinge trunnion 29.

After the ejection of the propulsion mechanism 70 and the respective flying time up to ignition, there occurs the following: the gas pressure of the disintegrator 1 causes the tearing off of the bolt 85 at the breaking location 88.

This gas pressure, pursuant to FIGS. 7*b* and *d*, separates the disintegrator support 81 together with the nose cone 80 from the body 82. Thereafter, the body 82 separates into the parts 82', 82". The torn off bolt part 85' detaches itself from the parts 82' and 82". The radially outwardly pivoting parts 82', 82" shear the shear pins 95 across the hinge support 8, 9, across the head 90 and across the bolt 86 so as to pull the piston 94 completely out the opening 96. The parts 82' and 82" are driven, by means of the static air pressure acting within the opening 101 and due the remaining projectile spin, in the direction of arrow A. Acting as pivot angle of the parts 82', 82", the fitted connection of these parts with the shank 50 is eliminated and the mentioned parts drop away from the shank 50. The projectile 71 is thus completely separated by the disintegrators 1. It is essential that the disintegrators 1 be so designed that a single disintegrator 1 will be adequate for the loosening of the projectile connection.

Figure 7D:
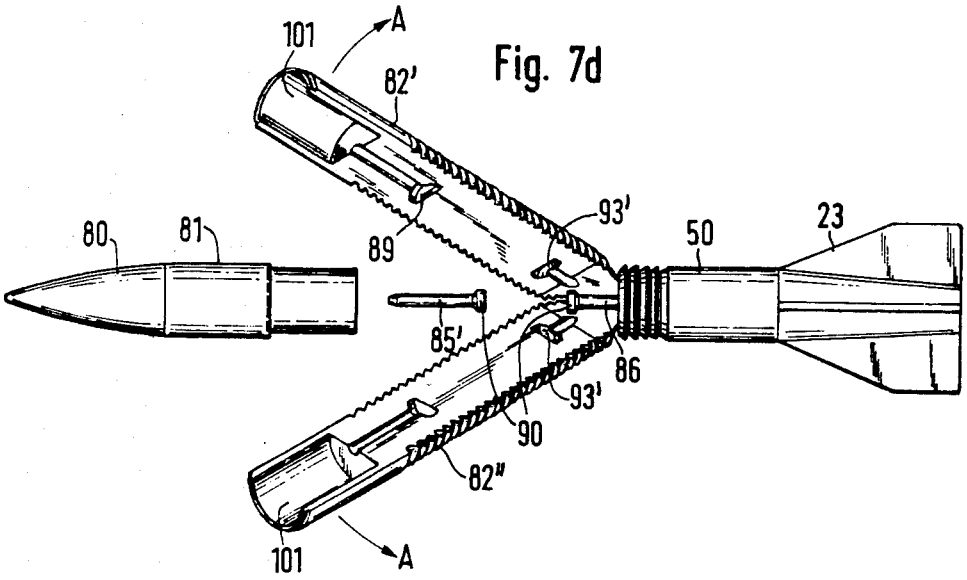
Figure 7E:
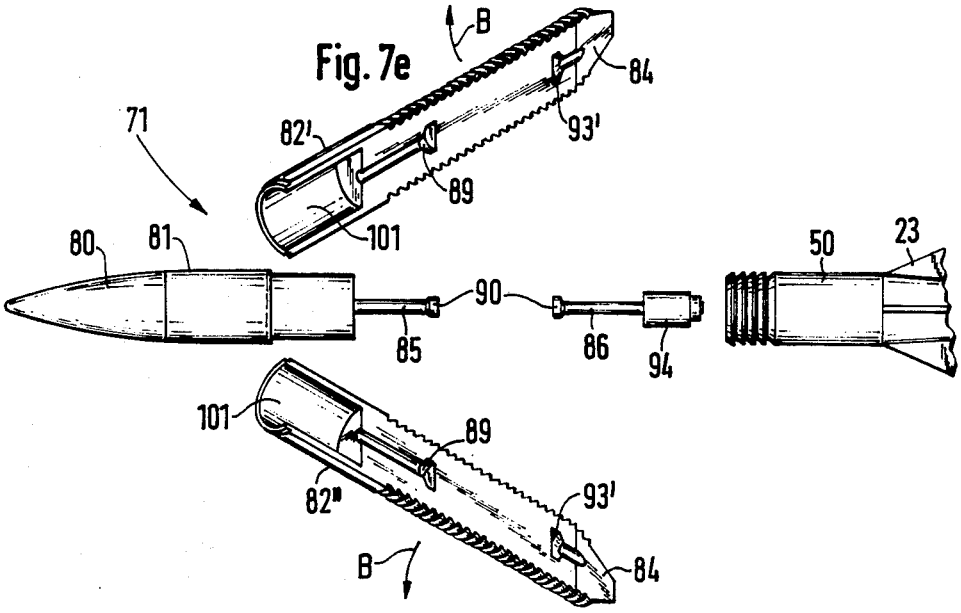

In the event that the self-destruct devices or disintegrators do not lead to the disintegration of the projectile 71, for example, through operational failure of the disintegrator 1, pursuant to FIG. 7*e* the gas pressure of the gas generator 30 which is ignited subsequent to the disintegrators 1 will shear the shear pins 95 and eject the parts 82', 82" from the opening 96. Through the loosening of the projectile connection effected from the rear, the parts 82' and 82", as a consequence of the remaining projectile spin, will detach from the nose cone 80 and the disintegrator support 81. The parts 82' and 82" hereby pivot radially outwardly in the direction of arrow B and in essence, due to the hinge support 6, 7, and as a result detach themselves from the disintegrator support 81.

Figure 8:
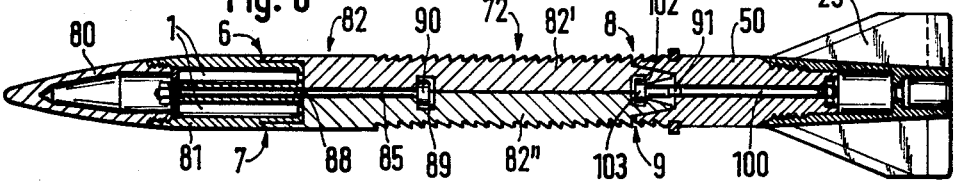

Pursuant to FIG. 8, arranged within the projectile 72 are two bolts 85, 100 in the body 82. The forward bolt will tear off due to the lever effect of the parts 82', 82". Upon release of the disintegrator support 81 with the nose cone 80 from the body 82, the static air pressure in the free opening 101 (FIG. 7*d*) will cause the parts 82', 82" to pivot radially outwardly in the direction of arrow A, and through their projections 102 and the head 103 will destroy the breaking location 91. Thereby, the parts 82', 82" will completely exit from the opening 96 and the individual projectile parts will fall to the ground.

Figure 9:
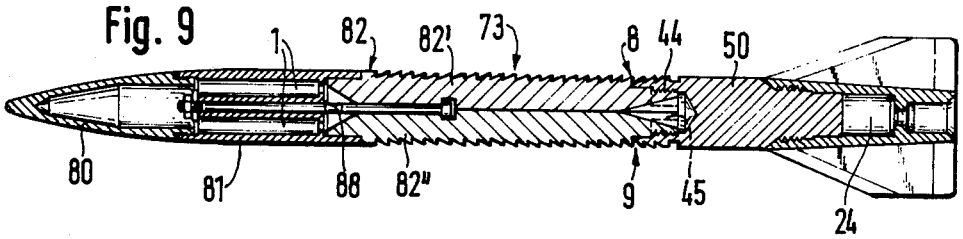

According to FIG. 9, the projectile 73 is modified in comparison with the projectile 72 of FIG. 8 in that the parts 82', 82" are screwed into the shank 50 by means of a threaded connection 44. Upon pivoting in the direction of arrow A about point C (FIG. 7*b*), there is released the threaded connection 44 so that the parts 82", 82' can exit from the opening 96. For this purpose, the sides of threads, as is indicated by reference numeral 45, extend for about 90°.

Figure 10:
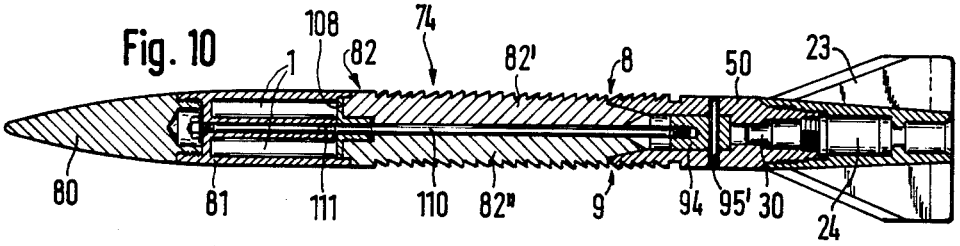
Figure 11:
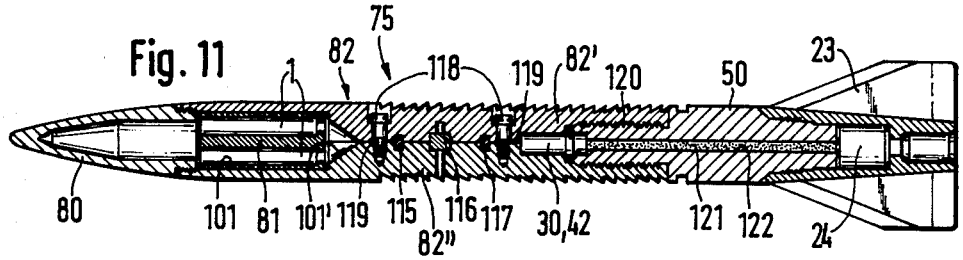

In accordance with FIG. 10, within the projectile 74 the disintegrator support 81 together with the nose cone 80, a piston 108, the parts 82' and 82" and the shank 50 are threaded together through a bolt 110 with breaking location 111 by means of the piston 94 fixed in the shank 50 by shear pin 95'. The piston 94 can be driven by the gas generator 30. After a predetermined time delay subsequent to the firing of the projectile, gas is generated by the disintegrators 1. The gas pressure leads to the rupture of the bolt 110 at the breaking location 111. The projectile 74 is then disintegrated in an analogous manner as is described with regard to FIG. 7. The disintegrator support 81 with the nose cone 80 is pushed away from the body 82 by the gas pressure.

Only thereafter is there ignited the gas generator 30. Due to the rupture of the shear pin 95', the piston 94 pushes the bolt 110 together with the piston 108 out of the shank 50. The parts 82', 82" are then radially pivoted about the hinges 6, 7 due to the static air pressure and the remaining spin, and removed from the shank 50.

In case of the failure of the disintegrator 1, the gas generator 30 alone will ensure the disintegration of the projectile 74. The piston 108 separates the disintegrator support 81 with the nose cone 80 from the body 82; the body 82 then divides into the parts 82' and 82", and the shank 50 together with the guidance mechanism 23 fly as individual components.

In case of the failure of the disintegrator 1, the gas generator 30 alone will ensure the disintegration of the projectile 74. The piston 108 separates the disintegrator support 81 with the nose cone 80 from the body 82; the body 82 then divides into the parts 82' and 82" are fixed through fitting members 115 to 117, and are connected by means of screws 118 with breaking locations 119. The body 82 possesses an opening 101 with a conically-shaped section 101' for receiving the disintegrator support 81 and the nose cone 80, as well as a two-stepped bore 120 for receiving the gas generator 30 with check valve 42 and the shank 50. The shank 50 contains a bore 122 into which there is pressed black powder 121.

The operating sequence is substantially as follows:

1. Initially there is generated gas pressure by the disintegrators 1. Thereby there are ruptured the screws 118. The projectile connection is separated into the components: (a) nose cone 80, (b) disintegrator support 81, (c) part 82', (d) part 82" and (e) shank 50 with guidance mechanism 23.

2. After a delay in time there will ignite the luminescent tracer arrangement 24 through the black powder 121 which is contained in the gas generator 30. Due to the already loosened projectile connection, this gas will escape freely.

3. In the event that the projectile connection is not released due to failure in the function of the disintegrator 1, or when the luminescent tracer arrangement 24 will ignite first, then the gas generator 30 will effect the disintegration of the projectile 75 as is described in paragraph 1 herein above.

Figure 12:
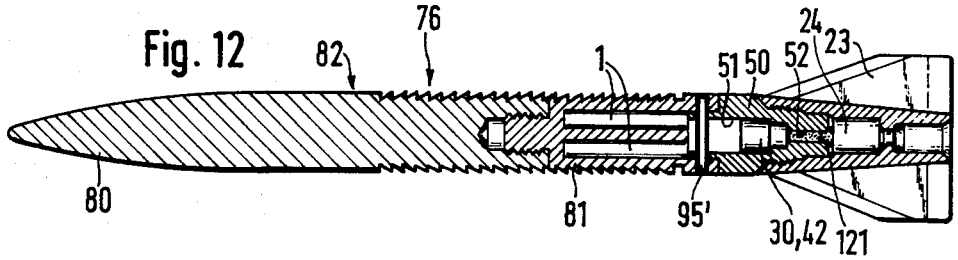

According to FIG. 12, the projectile 76 has the nose cone 80 and the body 82 formed unitarily. Screwed into the body 82 is the disintegrator support 81. The disintegrator support 81 is mounted on the shank 50 and secured by the shear pin 95. The shank 50 contains the gas generator together with check valve 42 within a bore 51. Pressed into a further bore 52 is black powder 121 as an igntion transmitter. The operating sequences are analogous to the sequence described in connection with FIG. 11. The distinction lies in that the projectile 76 is disintegrated into only two components, in essence, one consisting of the body 82 with the nose cone 80 and, secondly, into the disintegrator support 81 in the shank 50 with the guidance mechanism 23. The oppositely acting and concurrently generated gas pressures of the disintegrators 1 and of the gas generator 30 will cause the shank 50 and the disintegrator support 81 to pull apart. Due to the shear load, the shear pin 95' will rupture and the shank 50 is separated from the disintegrator support 81 and will rapidly drop to the ground.

Figure 13:
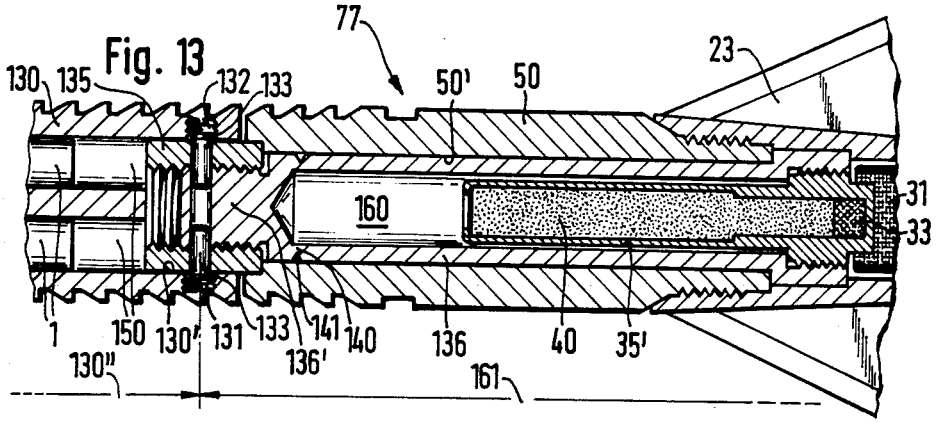
FIGS. 13 to 15 illustrate different details of practice projectiles.

According to FIG. 13, the projectile nose cone 80 and the disintegrator 1 of a projectile 77 consist of a single part 130. Threaded into part 130 are pins 131, 132 with predetermined breaking locations 133. These pins 131, 132 engage in the bores of sleeves 135, 136. The sleeve 136 also includes a breaking location 140 which is defined by an annular nitch 141. Arranged in the sleeve 136 is a cap 35' with the charge 40 and the compound 33. The disintegrators 1 and the charge 40 have gas chambers 150, 160 associated therewith. When the disintegrators 1 will ignite first, then the pins 131, 132 are sheared off and the part 130 is separated from the sleeve 135. Provided thereby is two-part projectile consisting of the parts 130" and the tail portion 161 with the parts 135, 40, 50, and 23. At subsequent ignition through the luminescent tracer 31 there is sheared the breaking location 140 and the head 136 is catapulted out of the bore 50'.

However, if the luminescent tracer 31 ignites first, then after the rupture of the breaking location 140, the shank 50 with the remaining portion of the sleeve 136 is pulled away from the head 136' and the sleeve 135. Hereby there is also attained a two-part projectile.

Figure 14:
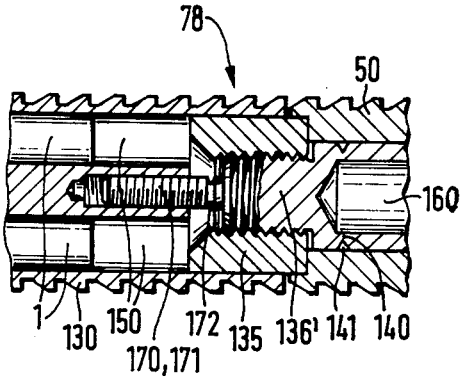

Pursuant to FIG. 14, in a projectile 78 there is to be seen a unit which differs from that of FIG. 13 in that instead of the shear pins 131, 132, a single bolt 170 integral with the head 136' will connect the part 130 with the parts 23, 50. The bolt 170 includes a screw thread 171 and a breaking location 172. Different in comparison with FIG. 13 is herein only the function that through the gas of the disintegrator 1 the bolt 170 is ripped apart at its breaking location 172.

Figure 15:
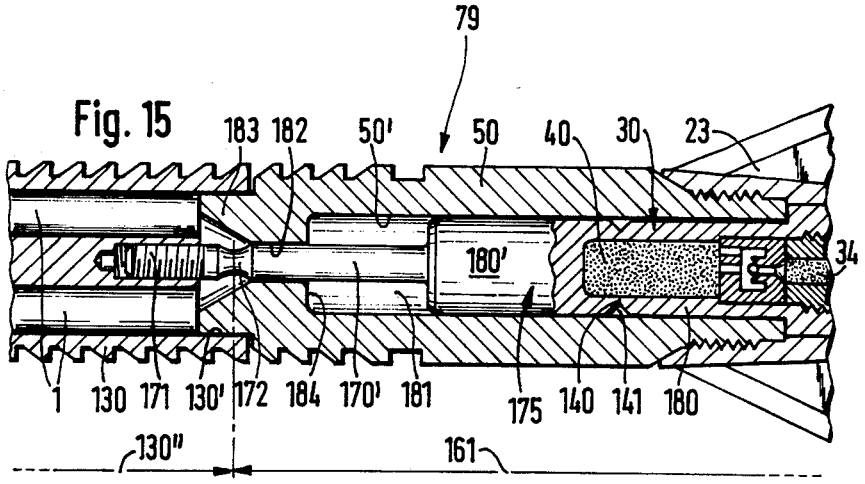

Pursuant to FIG. 15, in a projectile 79 there is located in the bore 50' a central connecting element 175. The latter consists of a sleeve 180 with piston 180', an annular notch 141 which defines the breaking location 140, a bolt 170' with breaking location 172 and screw thread 171, the details of the gas generator 30 described in connection with FIG. 2, and there is provided a free space 181. The bolt 170' is guided within a bore 182 and the part 130 with the bore 130' on an extension 183 of the shank 50 as as to be axially slideable. The action of the disintegrators 1 leads to the rupture of the bolt 170 at the breaking location 172 and to the ejection of the shank 50 from the bore 130'. However, when the luminescent trace precedingly ignites the charge 140, then the breaking location 140 will tear, and the piston 180' moves the part 130 in the direction of flight. The part 130 is thereby raised away from the extension 183. The piston 180' strikes against the wall 184. Due to the negative acceleration of the piston 180' in the opposite direction, the bolt 170' will tear against the breaking location 172. Produced hereby are two mutually separate projectile parts.

We claim:

1. Practice projectile consisting of at least two axially extending and transversely divided projectile parts; a single shear bolt extending centrally within and along the longitudinal axis of said practice projectile and interconnecting said projectile parts; a time-delayed self-destruct arrangement in said projectile for dividing said projectile into at least said projectile parts, said self-destruct arrangement being actuatable upon said projectile traversing a predetermined flying distance; said self-destruct arrangement comprising at least two mutually independent, pyrotechnic time-delay self-destruct means having gas-pressure generating charges constituted of a two-based propellant triggerable responsive to firing of the projectile, said bolt being shearable through the action of a gas pressure generated by said charges for effectuating the separation of said projectile parts.

2. Practice projectile as claimed in claim 1, wherein said two-based propellant comprises nitrocellulose having a high content of nitroglycerine.

3. Practice projectile as claimed in claim 1, wherein said shear means has breaking locations thereon to facilitate shearing of said shear means responsive to the generated gas pressure.

4. Practice projectile as claimed in claim 1, said projectile including a nose cone and supports for said self-destruct means; and a multi-part body and flight guidance means.

5. Practice projectile as claimed in claim 1, including said pyrotechnic time delay-acting self-destruct means having pyrotechnic gas generators being arranged within a housing in at least one of said projectile parts, said pyrotechnic self-destruct means being triggerable upon firing of said projectile.

6. Practice projectile as claimed in claim 5, said self-destruct means being arranged in said projectile so as to disintegrate said projectile into a nose cone part and base part.

7. Practice projectile as claimed in claim 5, comprising a gas generator forming a self-destruct means at the base end of the projectile and being triggerable by a tracer charge, said gas generator being connected to said tracer charge through a triggering passageway.

* * * * *